US011511973B2

(12) United States Patent
Yamane

(10) Patent No.: US 11,511,973 B2
(45) Date of Patent: Nov. 29, 2022

(54) CONTROL SYSTEM, CRANE FACILITY, CONTROL METHOD, AND RECORDING MEDIUM

(71) Applicant: MITSUBISHI HEAVY INDUSTRIES, LTD., Tokyo (JP)

(72) Inventor: Shigemi Yamane, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 81 days.

(21) Appl. No.: 17/335,248

(22) Filed: Jun. 1, 2021

(65) Prior Publication Data

US 2021/0395050 A1 Dec. 23, 2021

(30) Foreign Application Priority Data

Jun. 23, 2020 (JP) ..... JP2020-107638

(51) Int. Cl.

| | |
|---|---|
| ***B66C 13/44*** | (2006.01) |
| ***B66C 13/23*** | (2006.01) |
| ***B66C 13/30*** | (2006.01) |
| *B66C 15/06* | (2006.01) |

(52) U.S. Cl.

CPC ..... *B66C 13/44* (2013.01); *B66C 13/23* (2013.01); *B66C 13/30* (2013.01); *B66C 15/06* (2013.01)

(58) Field of Classification Search

CPC ..... B66C 13/23; B66C 13/30; B66C 13/44; B66C 15/065

See application file for complete search history.

(56) References Cited

U.S. PATENT DOCUMENTS

2019/0322498 A1* 10/2019 Andersson ..... B66C 13/46

FOREIGN PATENT DOCUMENTS

JP 2008-143613 A 6/2008

* cited by examiner

*Primary Examiner* — Michael R Mansen
*Assistant Examiner* — Juan J Campos, Jr.
(74) *Attorney, Agent, or Firm* — Manabu Kanesaka; Benjamin Hauptman; Ken Berner

(57) ABSTRACT

There is provided a control system including: a first transmission unit configured to transmit a first command directing an operation of a crane; a second transmission unit configured to transmit a second command directing an operation of the crane; and a control device including a first reception unit configured to accept the first command and a second reception unit configured to accept the second command, in which the control device is configured to operate the crane in a case in which the first command and the second command coincide with each other.

9 Claims, 6 Drawing Sheets

CONTROL SYSTEM, CRANE FACILITY, CONTROL METHOD, AND RECORDING MEDIUM

BACKGROUND OF THE INVENTION

Field of the Invention

The present disclosure relates to a control system, a crane facility, a control method, and a recording medium.

Priority is claimed on Japanese Patent Application No. 2020-107638, filed Jun. 23, 2020, the content of which is incorporated herein by reference.

Description of Related Art

Crane facilities in which a control system is disposed for operating a crane are known.

For example, Patent Document 1 discloses a crane facility in which a control system including a control device used for controlling an overhead crane is disposed.

PATENT DOCUMENTS

[Patent Document 1] Japanese Unexamined Patent Application, First Publication No. 2008-143613

SUMMARY OF THE INVENTION

In the crane facility disclosed in Patent Document 1, the control device informs of an operation state of the overhead crane using light or sounds, whereby an erroneous operation of the overhead crane is prevented.

However, even when the control device informs an operator of the operation state of the overhead crane, there are cases in which the operator performs an erroneous operation.

For this reason, in the case of the crane facility disclosed in Patent Document 1, there are cases in which an operator erroneously operates the crane through an erroneous operation.

An object of the present disclosure is to provide a control system, a crane facility, a control method, and a recording medium capable of preventing from an erroneous operation of a crane.

In order to solve the problems described above, according to the present disclosure, there is provided a control system including: a first transmission unit configured to transmit a first command directing an operation of a crane; a second transmission unit configured to transmit a second command directing an operation of the crane; and a control device including a first reception unit configured to accept the first command and a second reception unit configured to accept the second command, wherein the control device is configured to operate the crane in a case in which the first command and the second command coincide with each other.

According to the present disclosure, there is provided a control method including: accepting a first command from a first transmission unit that transmits the first command directing an operation of a crane; accepting a second command from a second transmission unit that transmits the second command directing an operation of the crane; and operating the crane in a case in which the first command and the second command coincide with each other.

According to the present disclosure, there is provided a non-transitory computer-readable recording medium that stores a program causing a computer of a control device of a control system including a first transmission unit configured to transmit a first command directing an operation of a crane and a second transmission unit configured to transmit a second command directing an operation of the crane to execute: accepting the first command from the first transmission unit; accepting the second command from the second transmission unit; and operating the crane in a case in which the first command and the second command coincide with each other.

According to a control system, a crane facility, a control method, and a recording medium of the present disclosure, a crane can be prevented from an erroneous operation.

DETAILED DESCRIPTION OF THE INVENTION

Hereinafter, embodiments of the present disclosure will be described with reference to the drawings. In all the drawings, the same reference signs will be assigned to components that are the same or that correspond to each other, and a common description will be omitted.

First Embodiment

A control system according to a first embodiment will be described with reference to FIGS. 1 to 5.

(Entire Configuration of Crane Facility)

A crane facility 9 is a facility that is used for conveying objects such as cargo.

An operator can hoist or move an object AA using the crane facility 9.

Figure 1:
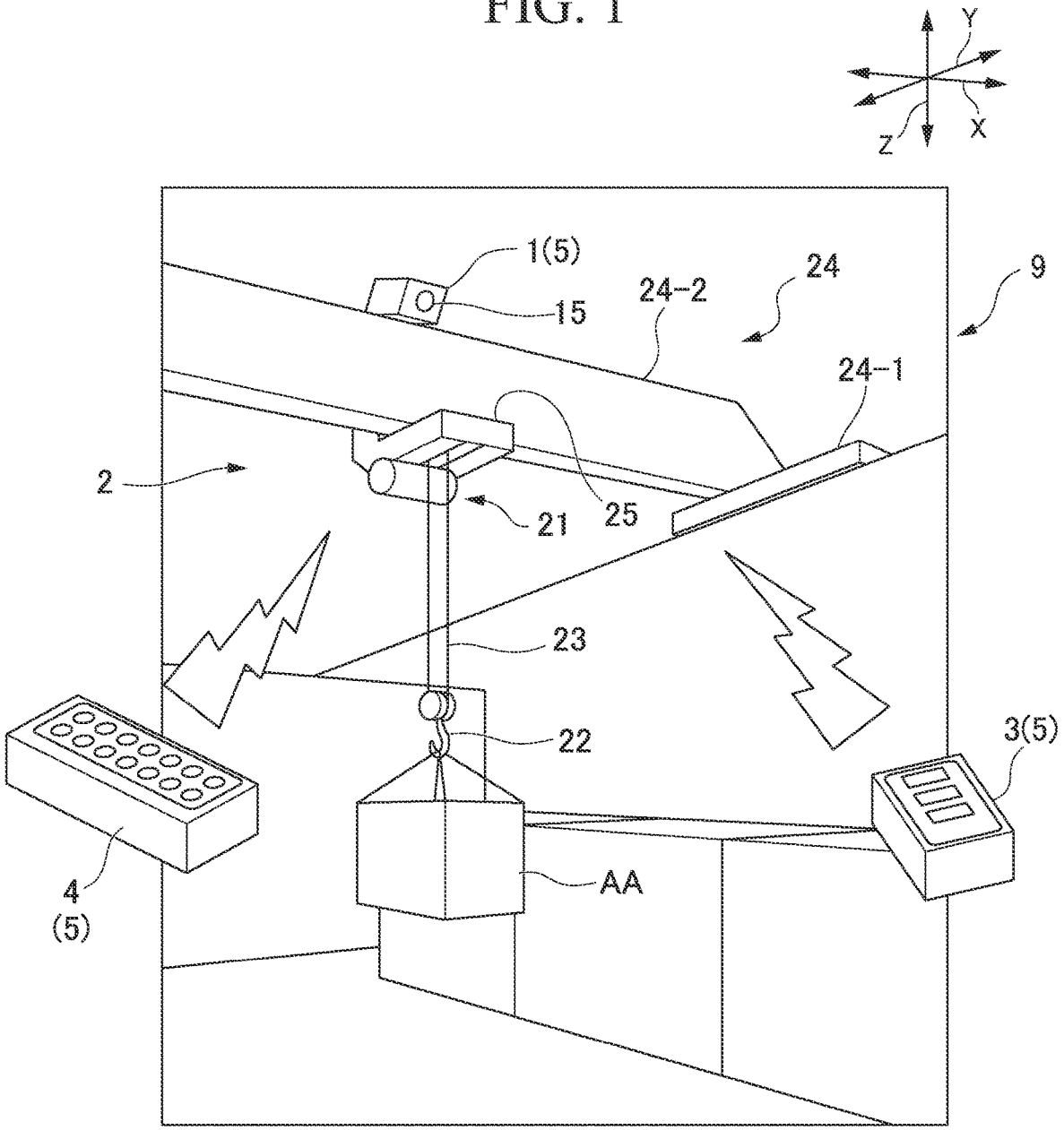
FIG. 1 is a conceptual diagram of a crane facility according to a first embodiment of the present disclosure.

As illustrated in FIG. 1, the crane facility 9 includes a control system 5 and a crane 2.

The control system 5 is a system that is used for manipulating an operation of the crane.

The control system 5 includes a control device 1, a first switching box 3 that is a first transmission unit, and a second switching box 4 that is a second transmission unit.

(Configuration of Crane)

The crane 2 is a mechanism that is used for hoisting and moving an object AA.

For example, the crane 2 may be an overhead crane.

For example, the crane 2 may include a hoist 25, a hook 22, a wire 23, and a horizontal moving mechanism 24.

The hoist 25 includes a driving mechanism 21 such as a motor.

The hoist 25 can wind or unwind the wire 23 by driving the driving mechanism 21 in accordance with a command from the control device 1.

At a lower end of the wire 23, the hook 22 into which the object AA can be hooked is disposed.

The object AA is hung on the hook 22.

In accordance with such a configuration, the hoist 25 can upper the object AA hung on the hook 22 by winding the wire 23.

On the other hand, the hoist 25 can lower the object AA hung on the hook 22 by unwinding the wire 23.

The horizontal moving mechanism 24 moves the hoist 25 within a horizontal plane in accordance with a command from the control device 1.

Hereinafter, one direction (for example, north/south) within the horizontal plane will also be referred to as an X direction.

In addition, a direction (for example, east/west) that is orthogonal to the X direction within the horizontal plane will also be referred to as a Y direction.

A vertical direction that is a direction orthogonal to the horizontal plane will also be referred to as a Z direction.

For example, the horizontal moving mechanism 24 may move the hoist 25 in the X direction and the Y direction.

For example, the horizontal moving mechanism 24 may include an X-direction moving mechanism 24-2 that can move the hoist 25 in the X direction and a Y-direction moving mechanism 24-1 that can move the X-direction moving mechanism 24-2 in the Y direction. At that time, the Y-direction moving mechanism 24-1 may be configured integrally with the X-direction moving mechanism 24-2 and may move the X-direction moving mechanism 24-2 in the Y direction together with the hoist 25 by traveling in the Y direction along such as a rail disposed on a roof.

For example, the X-direction moving mechanism 24-2 may include a crane garter, a trolley, a motor, and the like.

For example, the Y-direction moving mechanism 24-1 may include a saddle, vehicle wheels, a motor, and the like.

For example, when the horizontal moving mechanism 24 moves the hoist 25 in the X direction and the Y direction, the crane 2 may move a hanging object AA within the horizontal plane.

For example, when the horizontal moving mechanism 24 rotates the hoist 25 within the horizontal plane, the crane 2 may rotate a hanging object AA within the horizontal plane or invert a hanging object AA within the horizontal plane.

(Configuration of Control Device)

The control device 1 is a device for driving each mechanism of the crane 2 by sending a command to the crane 2.

For example, the control device 1 may drive the crane 2 such that it uppers or lowers the object AA by sending a command to the crane 2.

For example, the control device 1 may drive the crane 2 such that it moves the object AA in any one direction among four directions (east, west, south, and north) within the horizontal plane by sending a command to the crane 2.

For example, the control device 1 may drive the crane 2 such that it inverts an object AA within the horizontal plane by sending a command to the crane 2.

Figure 2:
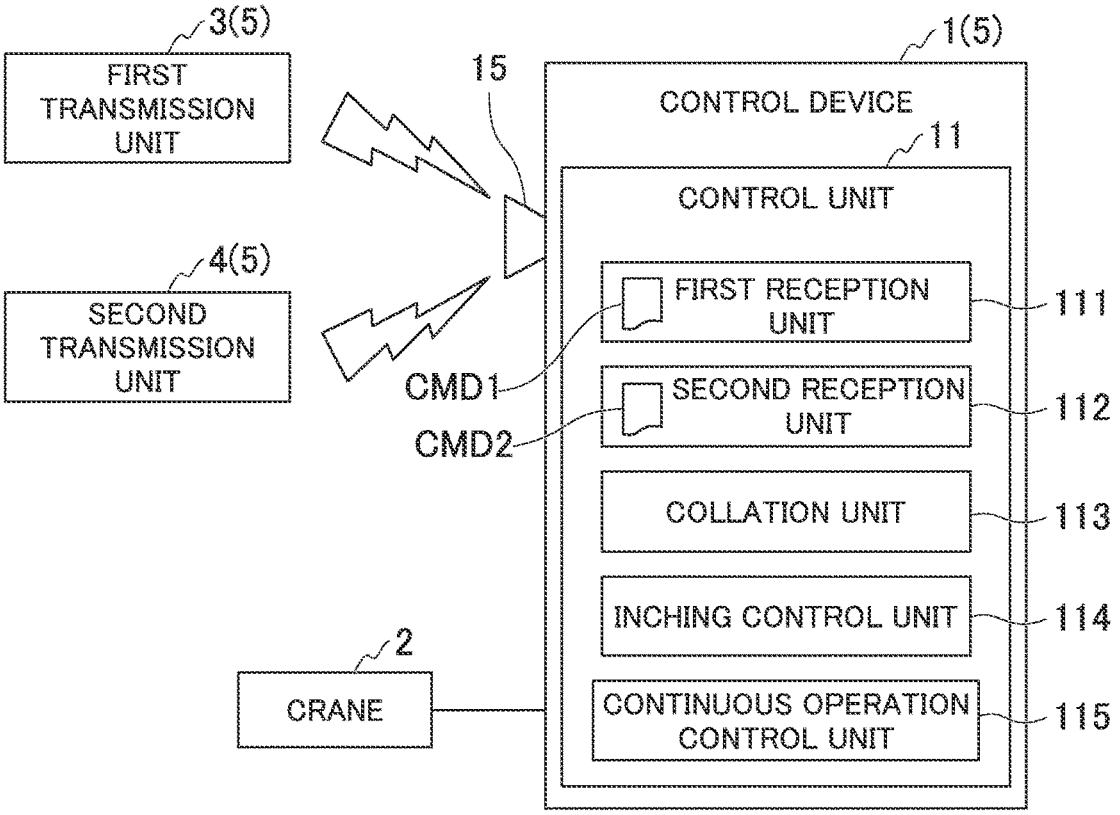
FIG. 2 is a block diagram of a control system according to the first embodiment of the present disclosure.

As illustrated in FIG. 2, the control device 1 functionally includes a first reception unit 111 and a second reception unit 112.

The first reception unit 111 accepts a first command CMD1 directing an operation of the crane 2.

The second reception unit 112 accepts a second command CMD2 directing an operation of the crane 2.

When the first command CMD1 and the second command CMD2 coincide with each other, the control device 1 operates the crane 2.

On the other hand, when the first command CMD1 and the second command CMD2 do not coincide with each other, the control device 1 may not operate the crane 2.

For example, the control device 1 may functionally include a first reception unit 111 and a second reception unit 112 as control units 11.

For example, the control device 1 may further include an antenna unit 15 that is capable of wirelessly communicating with a first transmission unit (a first switching box) 3 or a second transmission unit (a second switching box) 4.

For example, the antenna unit 15 may be configured to be capable of wirelessly communicating with the first transmission unit 3 and the second transmission unit 4.

For example, the control device 1 may receive a first command CMD1 from the first transmission unit 3.

For example, the control device 1 may receive a second command CMD2 from the second transmission unit 4.

For example, each of the first command CMD1 and the second command CMD2 may be a command directing uppering or lowering of the object AA using the crane 2.

For example, the control device 1 may send a command while connected to each mechanism of the crane 2 in a wired or wireless manner.

For example, the control device 1 may functionally further include a collation unit 113, an inching control unit 114, and a continuous operation control unit 115 as control units 11.

The collation unit 113 collates the first command CMD1 and the second command CMD2 with each other and determines whether or not the commands coincide with each other.

In a case in which the first command CMD1 and the second command CMD2 coincide with each other as a result of the determination of the collation unit 113, the control device 1 operates the crane 2 using a command corresponding to the second command CMD2.

On the other hand, in a case in which the first command CMD1 and the second command CMD2 do not coincide with each other as a result of the determination of the collation unit 113, the control device 1 may not operate the crane 2.

The inching control unit 114 inches the crane 2.

In a case in which the first command CMD1 and the second command CMD2 coincide with each other, the inching control unit 114 operates the crane 2 only for a predetermined short time using a command corresponding to the second command CMD2. After operating the crane 2 only for the predetermined short time, the inching control unit 114 stops the operation of the crane 2.

Here, the predetermined short time is a time within which inching of the crane 2 can be checked by an operator or a director and, for example, may be one second.

For example, when the first reception unit 111 and the second reception unit 112 accept commands directing to upper the object AA using the crane 2 as the first command CMD1 and the second command CMD2, the inching control unit 114 may upper the object AA for only one second using the crane 2. After uppering the object AA only for one second using the crane 2, the inching control unit 114 may stop uppering of the object AA using the crane 2.

The continuous operation control unit 115 continuously operates the crane 2.

Hereinafter, a "continuous operation" may be also referred to as a "continued operation."

After performing inching using the inching control unit 114, when the second reception unit 112 accepts the second command CMD2 that is the same as that at the time of inching again within a predetermined time (a continuous operation standby time), the continuous operation control unit 115 continuously operates the crane 2 using a command corresponding to the second command CMD2.

For example, the continuous operation standby time may be set to any time from 10 seconds to 30 seconds.

For example, while the second reception unit 112 is accepting the second command CMD2, the continuous operation control unit 115 may continuously operate the crane 2.

Then, when the second reception unit 112 becomes incapable of accepting the second command CMD2, the continuous operation control unit 115 may stop the operation of the crane 2.

For example, after uppering inching using the inching control unit 114, in a case in which the second reception unit 112 accepts a command directing to upper the object AA using the crane 2 as the second command CMD2 again within 30 seconds, while the second reception unit 112 is accepting the second command CMD2, the continuous operation control unit 115 continuously uppers the object AA using the crane 2.

Then, when the second reception unit 112 becomes incapable of accepting the second command CMD2, the continuous operation control unit 115 stops the uppering of the crane 2.

(Configuration of First Transmission Unit)

The first transmission unit (first switching box) 3 transmits a first command CMD1.

Figure 3:
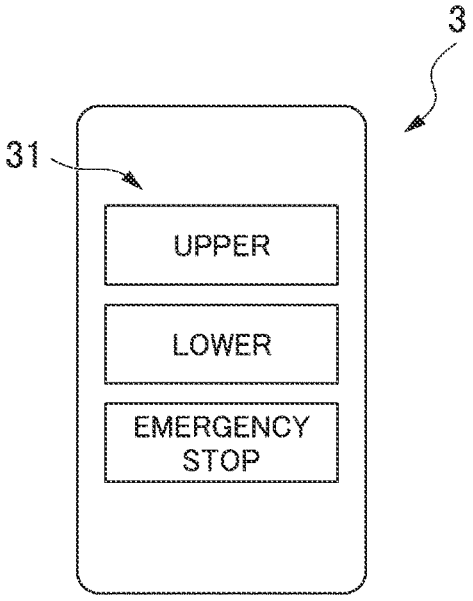
FIG. 3 is a plan view of a first transmission unit according to the first embodiment of the present disclosure.

For example, as illustrated in FIG. 3, the first transmission unit 3 may include a plurality of switches 31.

For example, the first transmission unit 3 may include a switch 31 for directing uppering of an object AA using the crane 2, a switch 31 for directing lowering of an object AA using the crane 2, a switch 31 for directing emergency stop of the crane 2, and the like as the plurality of switches 31.

For example, a director directing an operator to operate the crane 2 may hold the first transmission unit 3 and operate each of the switches 31.

When any one switch 31 among the plurality of switches 31 is pressed by a director, the first transmission unit 3 transmits a command relating to a direction of the pressed switch 31 to the control device 1.

For example, when the switch 31 for directing uppering among the plurality of switches 31 is pressed by the director, the first transmission unit 3 transmits the first command CMD1 that is a command for directing uppering to the control device 1.

For example, when the switch 31 for directing lowering among the plurality of switches 31 is pressed by the director, the first transmission unit 3 transmits the first command CMD1 that is a command for directing lowering to the control device 1.

For example, when the switch 31 for directing emergency stop among the plurality of switches 31 is pressed by the director, the first transmission unit 3 transmits a command for directing emergency stop to the control device 1.

(Configuration of Second Transmission Unit)

The second transmission unit (second switching box) 4 transmits the second command CMD2.

For example, the first transmission unit 3 and the second transmission unit 4 may be independent units.

For example, the second transmission unit 4 may be configured to be capable of being operated at a place that is remote from the first transmission unit 3.

Figure 4:
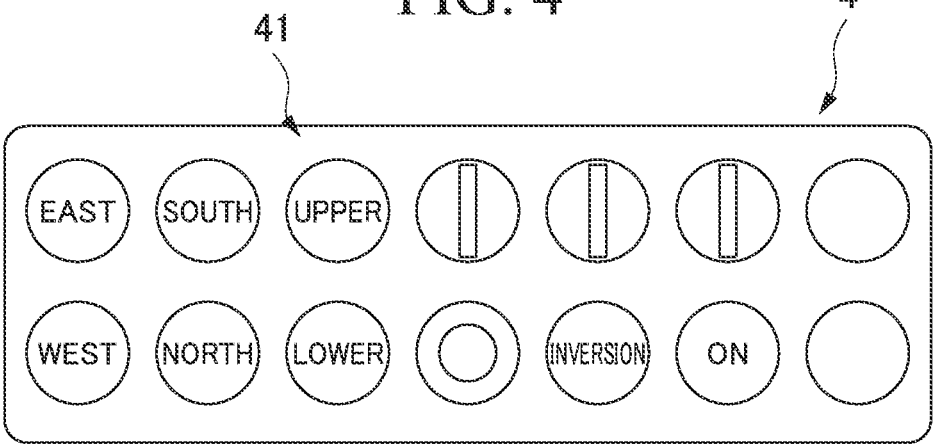
FIG. 4 is a plan view of a second transmission unit according to the first embodiment of the present disclosure.

For example, as illustrated in FIG. 4, the second transmission unit 4 includes a plurality of switches 41.

For example, the second transmission unit 4 may include a switch 41 for directing uppering of an object AA using the crane 2, a switch 41 for directing lowering of an object AA using the crane 2, a switch 41 for directing movement of an object AA in one horizontal direction using the crane 2, and the like as the plurality of switches 41.

For example, an operator who operates the crane 2 may hold the second transmission unit 4 and operate each of the switches 41.

When any one switch 41 among the plurality of switches 41 is pressed by an operator, the second transmission unit 4 transmits a command relating to a direction of the pressed switch 41 to the control device 1.

For example, when the switch 41 for directing uppering among the plurality of switches 41 is pressed by an operator, the second transmission unit 4 transmits the second command CMD2 that is a command for directing uppering to the control device 1.

For example, when the switch 41 for directing lowering among the plurality of switches 41 is pressed by an operator, the second transmission unit 4 transmits the second command CMD2 that is a command for directing lowering to the control device 1.

For example, when the switch 41 for directing movement in one horizontal direction among the plurality of switches 41 is pressed by an operator, the second transmission unit 4 transmits a command for directing movement in one horizontal direction to the control device 1.

(Operation)

An operation of the control device 1 according to this embodiment will be described.

The operation of the control device 1 corresponds to a control method according to the embodiment.

Figure 5:
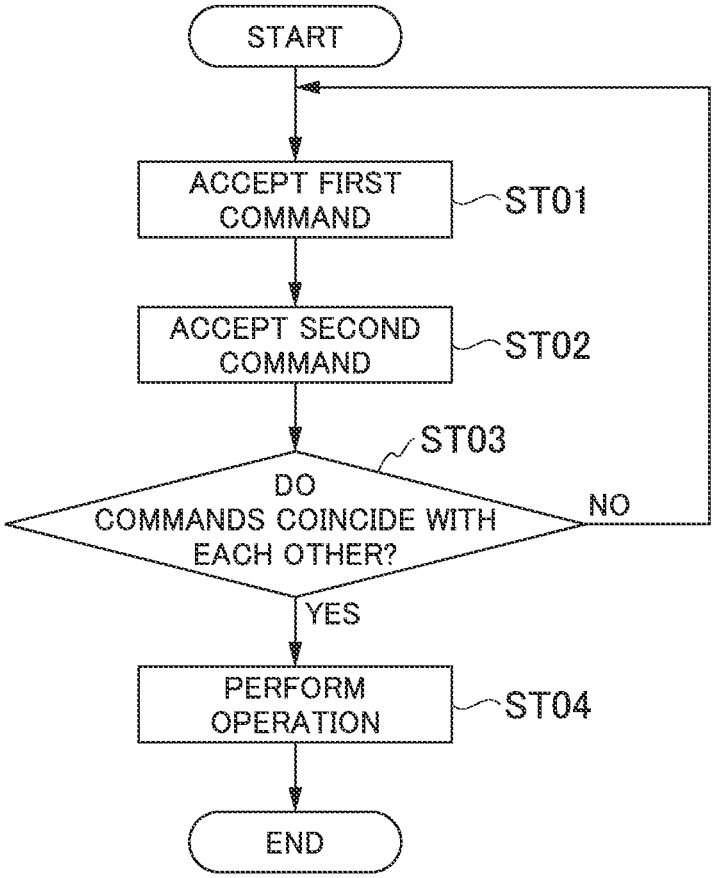
FIG. 5 is a flowchart of a control method according to the first embodiment of the present disclosure.

For example, as illustrated in FIG. 5, the control device 1 may perform each step.

First, the first reception unit 111 accepts a first command CMD1 for directing an operation of the crane 2 from the first transmission unit (the first switching box) 3 (ST01: first command acceptance step).

For example, the first reception unit 111 accepts a command relating to a direction of the switch 31 of the first transmission unit 3, which has been pressed by a director, as a first command CMD1.

After ST01 is performed, the second reception unit 112 accepts a second command CMD2 directing an operation of the crane 2 from the second transmission unit (the second switching box) 4 (ST02: second command acceptance step).

For example, the second reception unit 112 may accept a command relating to a direction of the switch 41 of the second transmission unit 4, which has been pressed by an operator, as a second command CMD2.

After ST02 is performed, the collation unit 113 collates the first command CMD1 with the second command CMD2 and determines whether or not the commands coincide with each other (ST03: collation step).

In a case in which the first command CMD1 coincides with the second command CMD2 (ST03: Yes), the control device 1 operates the crane 2 using a command corresponding to the second command CMD2 (ST04: operation step).

For example, it is assumed that a direction of the switch 31 that has been transmitted by a director is a command for directing to upper an object AA using the crane 2, and a direction of the switch 41 pressed by an operator is a command directing to upper the object AA using the crane 2.

In this case, both the first command CMD1 and the second command CMD2 are commands for directing to upper the object AA using the crane 2 and coincide with each other, and thus the control device 1 uppers the object AA using the crane 2.

At that time, after inching is performed using the inching control unit 114, the object AA may be uppered using the crane 2 in accordance with a continuous operation using the continuous operation control unit 115.

For example, during a continuous operation of the crane 2, when the switch 41 directing emergency stop of the crane 2 is pressed by a director, the control device 1 may interrupt the continuous operation of the crane 2 and stop the operation of the crane 2.

On the other hand, in a case in which the first command CMD1 does not coincide with the second command CMD2 (ST03: No), the control device 1 does not operate the crane 2 using a command corresponding to the second command CMD2 and causes the process to return to ST01.

For example, it is assumed that a direction of the switch 31 that has been transmitted by a director is a command directing to upper an object AA using the crane 2, and a direction of the switch 41 which has been transmitted by an operator is a command directing something other than uppering of the object AA using the crane 2 (for example, a command directing lowering of the object AA using the crane 2).

In this case, the first command CMD1 does not coincide with the second command CMD2, and thus the control device 1 does not operate the crane 2.

(Operation and Effect)

According to this embodiment, when the first command CMD1 and the second command CMD2, which have been accepted, coincide with each other, the control device 1 operates the crane 2.

Accordingly, when a direction intended by the first command CMD1 and a direction intended by the second command CMD2 coincide with each other, the crane 2 is operated.

For this reason, the control system 5 can perform operation management of the crane 2 using the first command CMD1 and can execute the operation of the crane 2 using the second command CMD2.

Therefore, the control system 5 can prevent from an erroneous operation of the crane 2.

In addition, according to one example of this embodiment, when the first command CMD1 and the second command CMD2 that have been accepted do not coincide with each other, the control device 1 does not operate the crane 2.

Accordingly, the crane 2 is not operated unless a direction intended by the first command CMD1 and a direction intended by the second command CMD2 coincide with each other.

For this reason, the control system 5 can perform operation management of the crane 2 using the first command CMD1 and can execute the operation of the crane 2 using the second command CMD2.

Therefore, the control system 5 can prevent form an erroneous operation of the crane 2.

In addition, according to one example of this embodiment, the first transmission unit 3 and the second transmission unit 4 are independent units, and thus the control device 1 can receive the first command CMD1 and the second command CMD2 respectively from the first transmission unit 3 and the second transmission unit 4 that are independently maintained, installed, or the like.

For this reason, the control system 5 can perform operation management of the crane 2 using the first command CMD1 and can execute the operation of the crane 2 using the second command CMD2 transmitted from an independent place from the place from which the first command CMD1 is transmitted.

Therefore, the control system 5 can prevent form an erroneous operation of the crane 2.

Furthermore, according to one example of this embodiment, the control device 1 includes an antenna unit 15 and thus can receive the first command CMD1 or the second command CMD2 from a remote place that is not fixed.

For this reason, the control system 5 can perform operation management of the crane 2 using the first command CMD1 transmitted from a remote place that is not fixed and can execute the operation of the crane 2 using the second command CMD2 transmitted from a remote place that is not fixed and remote from the place from which the first command CMD1 is transmitted.

Therefore, the control system 5 can prevent form an erroneous operation of the crane 2.

In addition, according to one example of this embodiment, the first command CMD1 and the second command CMD2 are commands directing uppering and lowering of an object AA using the crane 2, and thus the control system 5 can perform operation management of uppering or lowering of the crane 2 using the first command CMD1 and can execute a uppering operation or a lowering operation of the crane 2 using the second command CMD2.

Therefore, the control system 5 can prevent form an erroneous operation in uppering or lowering the crane 2.

Furthermore, according to one example of this embodiment, the control device 1 further includes the inching control unit 114 and the continuous operation control unit 115.

For this reason, the control system 5 can perform inching and a continuous operation of the crane 2.

Although ST02 is performed after ST01 in one example of this embodiment, the processing order is arbitrary as long as the first command CMD1 and the second command CMD2 can be accepted.

As a modified example, ST02 may be performed in parallel with ST01.

As another modified example, ST01 may be performed after ST02.

Although the control device 1 collates the first command CMD1 and the second command CMD2 for a command directing uppering of an object AA using the crane 2 in one example of this embodiment, the control device 1 may collate any commands as long as the control system 5 can prevent form an erroneous operation of the crane 2.

As a modified example, the control device 1 may collate the first command CMD1 and the second command CMD2 for a command directing lowering of an object AA using the crane 2.

As another modified example, the control device 1 may collate the first command CMD1 and the second command CMD2 for a command directing movement of an object AA in one direction among four directions (east, west, south, and north) within a horizontal plane using the crane 2. At that time, similar to the second transmission unit 4, the first transmission unit 3 may further include a switch 31 for directing movement of an object AA in one horizontal direction using the crane 2.

Second Embodiment

Next, a second embodiment of the present disclosure will be described with reference to FIGS. 6 and 7.

The configuration of a control system 5 according to this embodiment is similar to that according to the first embodiment except for the following points described below.

(Configuration)

In this embodiment, similar to the first embodiment, a control device 1 of the control system 5 is configured as illustrated in FIG. 2.

Figure 6:
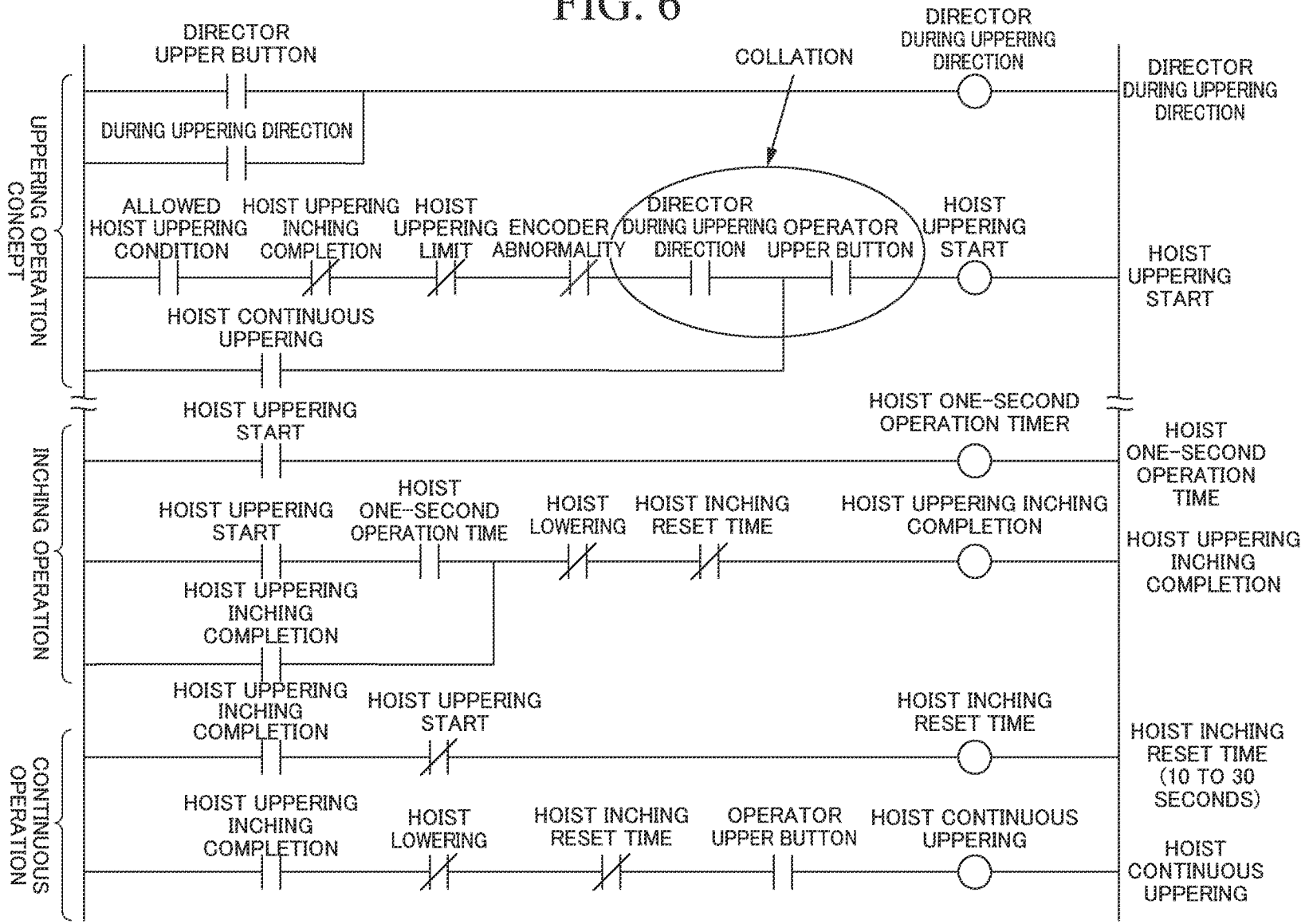
FIG. 6 is a sequence diagram of a control system according to a second embodiment of the present disclosure.

For example, the control device 1 may include a circuit or a computer that functions as in a sequence diagram illustrated in FIG. 6.

(Operation)

An operation of the control device 1 according to this embodiment will be described.

The operation of the control device 1 corresponds to an embodiment of a control method.

Figure 7:
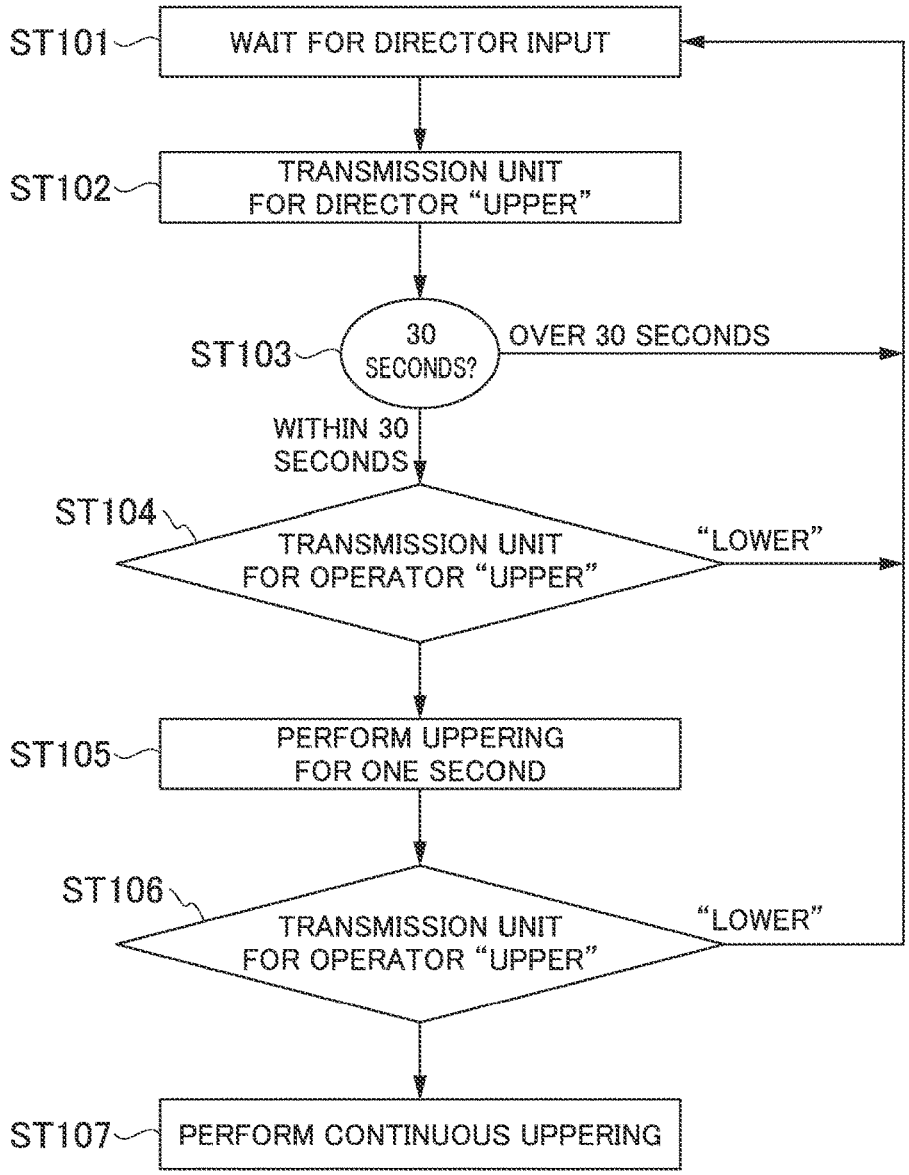
FIG. 7 is a flowchart of a control method according to the second embodiment of the present disclosure.

For example, as illustrated in FIG. 7, the control device 1 may perform each step.

For example, in the control system 5, a director may operate a first transmission unit 3, and an operator may operate a second transmission unit 4.

First, a first reception unit 111 waits for an input of a first command CMD1 from a director (ST101: first command standby step).

After performing ST101, the first reception unit 111 accepts a first command CMD1 from a director (ST102: first command acceptance step).

For example, when a switch 31 for directing uppering is pressed by a director, the first reception unit 111 accepts a command directing uppering of an object AA using a crane 2 as a first command CMD1.

After ST102, the second reception unit 112 accepts an input of a second command CMD2 from an operator (ST103: second command acceptance step).

In ST103, in a case in which the second reception unit 112 has not accepted a second command CMD2 even when a predetermined time elapses (for example, even when 30 seconds elapse) after the first reception unit 111 accepts a first command CMD1, the process returns to ST101, and the first reception unit 111 waits for an input of the first command CMD1 from a director again.

In ST103, in a case in which the second reception unit 112 has accepted a second command CMD2 within a predetermined time (for example, within 30 seconds) after the first reception unit 111 accepts a first command CMD1, the collation unit 113 collates the first command CMD1 and the second command CMD2 with each other and determines whether or not the first and second commands coincide with each other (ST104: collation step).

In ST104, in a case in which the second reception unit 112 accepts a command directing something other than uppering of an object AA using the crane 2 (for example, a command directing lowering) as a second command CMD2 from the operator, the process returns to ST101, and the first reception unit 111 waits for an input of the first command CMD1 from the director again.

In ST104, in a case in which the second reception unit 112 accepts a command directing to upper an object AA using the crane 2 as a second command CMD2 from the operator, the first command CMD1 and the second command CMD2 coincide with each other, and thus the inching control unit 114 causes the crane 2 to perform inching and uppers the object AA for only a predetermined time (for example, for only one second) (ST105: inching step).

After ST105, the continuous operation control unit 115 waits for a reinput of the second command CMD2 from the operator (ST106: re-command standby step).

For example, the continuous operation control unit 115 waits for an input of a command directing to upper an object AA using the crane 2 from the operator to the second reception unit 112 again within a predetermined time (a continuous operation standby time) as a second command CMD2.

For example, the continuous operation standby time may be set to any time from 10 seconds to 30 seconds.

In ST106, in a case in which the second reception unit 112 has not accepted the second command CMD2 again within a predetermined time, or a command directing something other than uppering (for example, a command directing lowering) has been accepted as a second command CMD2, the process returns to ST101, and the first reception unit 111 waits for an input of the first command CMD1 again from the director.

In ST106, in a case in which the second reception unit 112 has accepted a command directing uppering again within a predetermined time as a second command CMD2, the continuous operation control unit 115 continuously uppers an object AA by continuously operating the crane 2 while the second reception unit 112 is accepting the second command CMD2 (ST107: continuous operation step).

(Operation and Effect)

According to one example of this embodiment, the control device 1 determines whether or not the first command CMD1 and the second command CMD2 coincide with each other by collating them with each other.

Therefore, similar to the first embodiment, the control system 5 can prevent form an erroneous operation of the crane 2.

Figure 8:
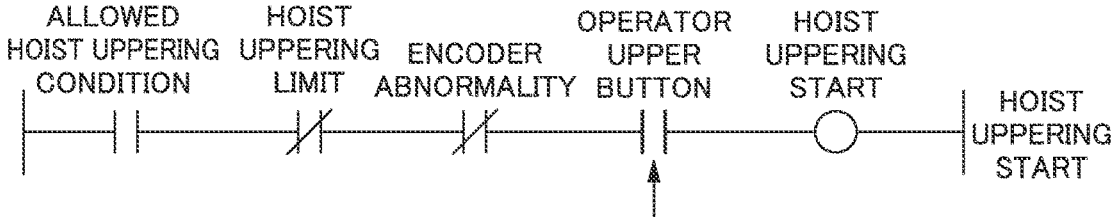
FIG. 8 is a sequence diagram of a control system according to a comparative example of the present disclosure.

As a comparative example, in a case in which a control device is configured using a circuit that functions as in a sequence diagram illustrated in FIG. 8, the control device immediately uppers a hoist in accordance with only a upper command from an operator.

For this reason, there are cases in which an operator erroneously operates a crane in accordance with an erroneous operation.

In contrast to this, as in one example of this embodiment, in a case in which the control device 1 is configured using a circuit that functions as in a sequence diagram illustrated in FIG. 6, the first command CMD1 and the second command CMD2 can be collated with each other.

Therefore, the control system 5 can prevent form an erroneous operation of the crane 2.

Modified Example

In the example of each embodiment described above, although the first reception unit 111 accepts a first command CMD1 transmitted by an operation of a director on the first transmission unit 3, the first reception unit 111 may accept any first command CMD1 as long as operation management of the crane 2 using the first command CMD1 can be performed.

As a modified example, a first command CMD1 corresponding to a command direction that is stored in the first transmission unit 3 in advance or that is programmed in the first transmission unit 3 in advance may be transmitted from the first transmission unit 3 to the control device 1. In other words, the first reception unit 111 may accept a first command CMD1 corresponding to a command that is stored in the first transmission unit 3 in advance or that is programmed in the first transmission unit 3 in advance.

According to this modified example, the control system 5 can perform operation management for managing whether or not a first command CMD1 corresponding to a command that is stored in the first transmission unit 3 in advance or that is programmed in the first transmission unit 3 in advance coincides with a second command CMD2 that is a command to the crane 2 from an operator.

For this reason, the control system 5 can prevent form an erroneous operation of the crane 2, for example, without needing an operation of a director.

As another modified example, a first command CMD1 corresponding to a command that is stored in the control device 1 in advance or that is programmed in the control device 1 in advance may be transmitted to the first reception unit 111. In other words, the first reception unit 111 may accept a first command CMD1 corresponding to a command that is stored in the control device 1 in advance or that is programmed in the control device 1 in advance.

According to this another modified example, the control system 5 can perform operation management for managing whether or not the first command CMD1 corresponding to a command that is stored in the control device 1 in advance or that is programmed in the control device 1 in advance coincides with a second command CMD2 that is a command to the crane 2 from an operator.

For this reason, the control system 5 can prevent form an erroneous operation of the crane 2, for example, without needing an operation of a director.

In the example of each embodiment described above, although the control device 1 can wirelessly communicate with the first transmission unit 3 and the second transmission unit 4, the control device may be configured in any way as long as it can communicate with the first transmission unit 3 and the second transmission unit 4.

As a modified example, the control device 1 may communicate with the first transmission unit 3 in a wired manner.

As another modified example, the control device 1 may communicate with the second transmission unit 4 in a wired manner.

In the example of each embodiment described above, although the control system 5 is applied to an overhead crane, it may be applied to any type of crane.

As a modified example, the control system 5 may also be applied to a telpher, a jib crane, a mobile crane, and the like.

In addition, in each embodiment described above, in the control device 1, a program for realizing various functions of the control unit 11 is recorded on a computer-readable recording medium, and a computer system called a microcomputer is caused to read and execute the program recorded on this recording medium, whereby various processes are performed. Here, the procedure of various processes of a CPU of the computer system is stored on a computer-readable recording medium in the form of a program, and this program is read and executed by a computer, whereby various processes described above are performed. The computer-readable recording medium refers to a magnetic disk, a magneto-optical disc, a CD-ROM, a DVD-ROM, a semiconductor memory, or the like. This computer program may be distributed to a computer through a communication line, and the computer that has received this distribution may execute the program.

In each embodiment described above, an example of a hardware configuration of the computer executing the program for realizing various functions of the control unit 11 will be described.

Figure 9:
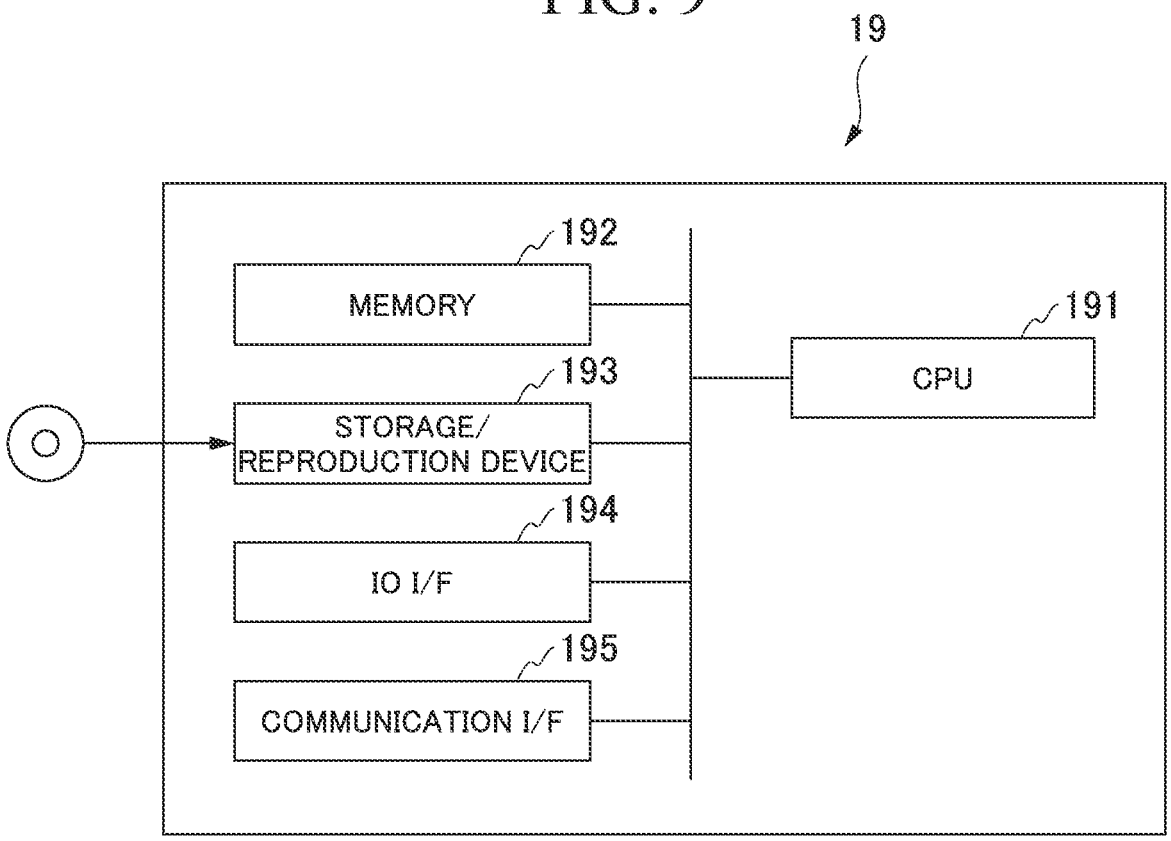
FIG. 9 is a block diagram of an example of a hardware configuration of a computer included in a control device according to embodiments of the present disclosure.

As illustrated in FIG. 9, a computer 19 included in the control device 1 includes a CPU 191, a memory 192, a storage/reproduction device 193, an input/output interface (hereinafter, referred to as "IO I/F") 194, and a communication interface (hereinafter, referred to as "communication I/F") 195.

The memory 192 is a medium such as a random access memory (hereinafter, referred to as a "RAM") that temporarily stores data used in a program executed by the control device 1 and the like.

The storage/reproduction device 193 is a device used for storing data and the like in an external medium such as a CD-ROM, a DVD, and a flash memory, or reproducing data and the like of the external medium.

The IO I/F 194 is an interface for inputting/outputting information and the like between the control device 1 and another device.

The communication I/F 195 is an interface for performing communication with other devices through a communication line such as the Internet, a dedicated communication line, and the like.

Although an embodiment of the present disclosure has been described above, this embodiment is shown as an example and is not intended to limit the scope of the present disclosure. This embodiment can be implemented in various other forms, and various omissions, replacements, and changes can be made without departing from the gist of the present disclosure. This embodiment and modification thereof are included in the scope and gist of the present disclosure.

<Supplementary Notes>

For example, a control system, a crane facility, a control method, and a program according to the embodiments described above are understood as below.

(1) According to a first aspect, there is provided a control system 5 including: a first transmission unit 3 configured to transmit a first command CMD1 directing an operation of a crane 2; a second transmission unit 4 configured to transmit a second command CMD2 directing an operation of the crane 2; and a control device 1 including a first reception unit 111 configured to accept the first command CMD1 and a second reception unit 112 configured to accept the second command CMD2, wherein the control device 1 is configured to operate the crane 2 in a case in which the first command CMD1 and the second command CMD2 coincide with each other.

As an example of the first transmission unit, for example, there is a first switching box.

As an example of the second transmission unit, for example, there is a second switching box.

According to this aspect, the control device 1 operates the crane 2 when the first command CMD1 and the second command CMD2, which have been accepted, coincide with each other.

Accordingly, when a direction intended by the first command CMD1 and a direction intended by the second command CMD2 coincide with each other, the crane 2 is operated.

For this reason, the control system 5 can perform operation management of the crane 2 using the first command CMD1 and can execute the operation of the crane 2 using the second command CMD2.

Therefore, the control system 5 can prevent form an erroneous operation of the crane 2.

(2) A control system 5 according to a second aspect is the control system 5 of (1), wherein the crane 2 is not operated in a case in which the first command CMD1 and the second command CMD2 do not coincide with each other.

According to this aspect, the control device 1 does not operate the crane 2 in a case in which the first command CMD1 and the second command CMD2 that have been accepted do not coincide with each other.

Accordingly, the crane 2 is not operated unless a direction intended by the first command CMD1 and a direction intended by the second command CMD2 coincide with each other.

For this reason, the control system 5 can perform operation management of the crane 2 using the first command CMD1 and can execute the operation of the crane 2 using the second command CMD2.

Therefore, the control system 5 can prevent form an erroneous operation of the crane 2.

(3) A control system 5 according to a third aspect is the control system 5 of (1) or (2), wherein the first transmission unit 3 and the second transmission unit 4 are independent units.

According to this aspect, the control device 1 can receive the first command CMD1 and the second command CMD2, respectively, from the first transmission unit 3 and the second transmission unit 4 that are independently maintained, installed, or the like.

For this reason, the control system 5 can perform operation management of the crane 2 using the first command CMD1 and can execute the operation of the crane 2 using the second command CMD2 transmitted from an independent place from the place from which the first command CMD1 is transmitted.

Therefore, the control system 5 can prevent form an erroneous operation of the crane 2.

(4) A control system 5 according to a fourth aspect is the control system 5 of (3), wherein the control device 1 further includes an antenna unit 15 that is capable of wirelessly communicating with the first transmission unit 3 or the second transmission unit 4.

According to this aspect, the control device 1 can receive the first command CMD1 or the second command CMD2 from a remote place that is not fixed.

For this reason, the control system 5 can perform operation management of the crane 2 using the first command CMD1 transmitted from a remote place that is not fixed and can execute the operation of the crane 2 using the second command CMD2 transmitted from a remote place that is not fixed and remote from the place from which the first command CMD1 is transmitted.

Therefore, the control system 5 can prevent form an erroneous operation of the crane 2.

(5) A control system 5 according to a fifth aspect is the control system 5 of any one of (1) to (4), wherein the first command CMD1 and the second command CMD2 are commands directing uppering or lowering of an object AA using the crane 2.

According to this aspect, the control system 5 can manage a uppering operation or a lowering operation of the crane 2 using the first command CMD1 and can execute a uppering operation or a lowering operation of the crane 2 using the second command CMD2.

Therefore, the control system 5 can prevent form an erroneous operation in uppering or lowering the crane 2.

(6) A control system 5 according to a sixth aspect is the control system 5 of any one of (1) to (5), wherein the control device 1 further includes an inching control unit 114 configured to inch the crane 2 and a continuous operation control unit 115 configured to continuously operate the crane 2.

According to this aspect, the control system 5 can inch and continuously operate the crane 2.

(7) A crane facility 9 according to a seventh aspect includes the control system 5 according to any one of (1) to (6) and the crane 2.

According to this aspect, the crane facility 9 operates the crane 2 in a case in which the first command CMD1 and the second command CMD2 coincide with each other.

Accordingly, when a direction intended by the first command CMD1 and a direction intended by the second command CMD2 coincide with each other, the crane 2 is operated.

For this reason, the crane facility 9 can perform operation management of the crane 2 using the first command CMD1 and can execute the operation of the crane 2 using the second command CMD2.

Therefore, the crane facility 9 can prevent form an erroneous operation of the crane 2.

(8) According to an eighth aspect, there is provided a control method including: accepting a first command CMD1 from a first transmission unit 3 that transmits the first command CMD1 directing an operation of a crane 2; accepting a second command CMD2 from a second transmission unit 4 that transmits the second command CMD2 directing an operation of the crane 2; and operating the crane 2 in a case in which the first command CMD1 and the second command CMD2 coincide with each other.

As an example of the first transmission unit, for example, there is a first switching box.

As an example of the second transmission unit, for example, there is a second switching box.

According to this aspect, in the control method, the crane 2 is operated in a case in which the first command CMD1 and the second command CMD2 coincide with each other.

Accordingly, when a direction intended by the first command CMD1 and a direction intended by the second command CMD2 coincide with each other, the crane 2 is operated.

For this reason, in the control method, operation management of the crane 2 is performed using the first command CMD1, and the operation of the crane 2 can be executed using the second command CMD2.

Therefore, the control method can prevent form an erroneous operation of the crane 2.

(9) According to a ninth aspect, there is provided a program causing a computer of a control device 1 of a control system 5 including a first transmission unit 3 configured to transmit a first command CMD1 directing an operation of a crane 2 and a second transmission unit 4 configured to transmit a second command CMD2 directing an operation of the crane 2 to execute: accepting the first command CMD1 from the first transmission unit 3; accepting the second command CMD2 from the second transmission unit 4; and operating the crane 2 in a case in which the first command CMD1 and the second command CMD2 coincide with each other.

As an example of the first transmission unit, for example, there is a first switching box.

As an example of the second transmission unit, for example, there is a second switching box.

According to this aspect, the control device in which the program is executed operates the crane 2 in a case in which the first command CMD1 and the second command CMD2, which have been accepted, coincide with each other.

Accordingly, when a direction intended by the first command CMD1 and a direction intended by the second command CMD2 coincide with each other, the crane 2 is operated.

For this reason, the control device in which the program is executed can perform operation management of the crane 2 using the first command CMD1 and can execute the operation of the crane 2 using the second command CMD2.

Therefore, the program can prevent form an erroneous operation of the crane 2.

According to the control system, the crane facility, the control method, and the program of the present disclosure, a crane can be prevented form an erroneous operation.

EXPLANATION OF REFERENCES

1 Control device
2 Crane
3 First transmission unit (first switching box)
4 Second transmission unit (second switching box)
5 Control system
9 Crane facility
11 Control unit
15 Antenna unit
19 Computer
21 Driving mechanism
22 Hook
23 Wire
24 Horizontal moving mechanism
24-1 Y-direction moving mechanism
24-2 X-direction moving mechanism
25 Hoist
31 Switch
41 Switch
111 First reception unit
112 Second reception unit
113 Collation unit
114 Inching control unit
115 Continuous operation control unit
191 CPU
192 Memory
193 Storage/reproduction device
194 IO I/F
195 Communication I/F
AA Object
CMD1 First command
CMD2 Second command

What is claimed is:

1. A control system comprising:
a first transmission unit configured to transmit a first command directing an operation of a crane;
a second transmission unit configured to transmit a second command directing an operation of the crane; and
a control device including a first reception unit configured to accept the first command and a second reception unit configured to accept the second command,
wherein the control device is configured to operate the crane in a case in which the first command and the second command coincide with each other.

2. The control system according to claim 1, wherein the crane is not operated in a case in which the first command and the second command do not coincide with each other.

3. The control system according to claim 1, wherein the first transmission unit and the second transmission unit are independent units.

4. The control system according to claim 3, wherein the control device further includes an antenna unit that is capable of wirelessly communicating with the first transmission unit or the second transmission unit.

5. The control system according to claim 1, wherein the first command and the second command are commands directing uppering or lowering of an object using the crane.

6. The control system according to claim 1, wherein the control device further includes an inching control unit configured to inch the crane and a continuous operation control unit configured to continuously operate the crane.

7. A crane facility comprising:
the control system according to claim 1; and
the crane.

8. A control method comprising:
accepting a first command from a first transmission unit that transmits the first command directing an operation of a crane;
accepting a second command from a second transmission unit that transmits the second command directing an operation of the crane; and
operating the crane in a case in which the first command and the second command coincide with each other.

9. A non-transitory computer-readable recording medium that stores a program causing a computer of a control device of a control system including a first transmission unit configured to transmit a first command directing an operation of a crane and a second transmission unit configured to transmit a second command directing an operation of the crane to execute:
accepting the first command from the first transmission unit;
accepting the second command from the second transmission unit; and
operating the crane in a case in which the first command and the second command coincide with each other.

* * * * *